US006390077B1

(12) United States Patent
Simpson et al.

(10) Patent No.: US 6,390,077 B1
(45) Date of Patent: May 21, 2002

(54) ADAPTIVE FLOW RESTRICTION TEST METHOD FOR AN EXHAUST GAS RECIRCULATION SYSTEM

(75) Inventors: Kenneth M. Simpson, Howell; Michael T. Cottrell, White Lake; Stephen F. Majkowski, Rochester Hills; Hallett D. Breidenbach, West Bloomfield; Alton L. Schuessler, Flint, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/816,938

(22) Filed: Sep. 13, 2000

Related U.S. Application Data

(60) Provisional application No. 60/161,840, filed on Oct. 27, 1999.

(51) Int. Cl.[7] ..... F02M 25/07

(52) U.S. Cl. ..... 123/568.16; 73/117.3

(58) Field of Search ..... 123/568.16, 568.11; 73/117.3, 118.1, 117.2, 118.2

(56) References Cited

U.S. PATENT DOCUMENTS

| | | | | |
|---|---|---|---|---|
| 5,309,887 A | | 5/1994 | Kondo et al. | 123/571 |
| 5,368,005 A | * | 11/1994 | Kako | 123/568.16 |
| 5,508,926 A | * | 4/1996 | Wade | 123/568.16 |
| 5,542,400 A | | 8/1996 | Matsumoto et al. | 123/571 |
| 6,024,075 A | * | 2/2000 | Bidner et al. | 123/568.16 |

FOREIGN PATENT DOCUMENTS

| | | | |
|---|---|---|---|
| JP | 07004320 | 1/1995 | F02M/27/07 |

* cited by examiner

*Primary Examiner*—Henry C. Yuen
*Assistant Examiner*—Arnold Castro
(74) *Attorney, Agent, or Firm*—Vincent A. Cichosz

(57) ABSTRACT

An improved test method for an EGR system reliably detects debilitating EGR system restrictions without significantly degrading combustion stability and exhaust emissions. The EGR valve test opening for diagnostic purposes is initialized at a relatively low value, which is progressively increased if the resulting change in intake manifold pressure fails to exceed a threshold based on the minimum expected change in intake manifold pressure for an EGR system that is regarded as functioning within acceptable limits. As soon as the measured pressure change exceeds the threshold, the EGR system is deemed to pass the restriction test, and the test method is terminated. If the EGR valve opening reaches a maximum value without the measured pressure exceeding the threshold, the EGR system is deemed to fail the restriction test, and a fault indication is generated. Consequently, the test opening of the EGR valve is adaptively determined based on the measured intake manifold pressure change, and is never larger than required to reliably detect a debilitating EGR restriction. This allows reliable detection of a borderline failing EGR system, while preventing degradation of combustion stability and emissions in a substantially unrestricted EGR system.

4 Claims, 1 Drawing Sheet

ADAPTIVE FLOW RESTRICTION TEST METHOD FOR AN EXHAUST GAS RECIRCULATION SYSTEM

CROSS-REFERENCE TO RELATED APPLICATION(S)

The present invention claims the priority date of copending U.S. Provisional Patent Application Ser. No. 60/161,840, filed Oct. 27, 1999.

TECHNICAL FIELD

The present invention relates to vehicle diagnostic systems, and more particularly to a method of testing for flow restrictions in an engine exhaust gas recirculation system.

BACKGROUND OF THE INVENTION

Vehicle exhaust gas emissions are commonly reduced with an exhaust gas recirculation (EGR) valve controlled to allow engine exhaust gas to flow back into the intake air stream of the engine. The recirculated exhaust gas reduces peak temperatures within the combustion chamber, which in turn, reduces the formation of oxides of nitrogen (NOX). However, various exhaust gas passages in the EGR system may become restricted due to physical damage or formation of deposits (coking), allowing the peak combustion temperatures and NOX emissions to increase.

To satisfy diagnostic requirements, the engine controller is programmed to periodically run a diagnostic procedure that tests for flow restrictions and produces a fault indication if a debilitating restriction is detected. Typically, the procedure involves forcing the EGR valve to a predetermined opening when it would otherwise be closed, and measuring the resulting change in intake manifold absolute pressure. The EGR system is deemed to pass the test if the measured change in pressure exceeds a threshold based on the minimum expected change in intake manifold pressure for an EGR system that is regarded as functioning within acceptable limits, but is deemed to fail the test if the measured pressure change is below the threshold. Unfortunately, a large EGR valve opening is required to distinguish between a borderline passing restriction and a borderline failing restriction, and if the system is relatively unrestricted, the large opening results in a high EGR flow that can cause combustion instability and increase exhaust emissions. Using a smaller EGR valve opening to avoid these problems makes it difficult to reliably detect a debilitating restriction, and tends to increase the variability of the test results.

SUMMARY OF THE INVENTION

The present invention is directed to an improved test method for detecting EGR system restrictions which can reliably detect a debilitating restriction without significantly degrading combustion stability and exhaust emissions.

According to this invention, the EGR valve opening for diagnostic purposes (referred to herein as the test opening) is initialized at a relatively low value, which is progressively increased if the measured intake manifold pressure change fails to exceed a threshold based on the minimum expected change in intake manifold pressure for an EGR system which is regarded as functioning within acceptable limits. As soon as the measured pressure change exceeds the threshold, the EGR system is deemed to pass the restriction test, and the test method is terminated. If the EGR valve opening reaches a maximum value without the measured pressure exceeding the threshold, the EGR system is deemed to fail the restriction test, and a fault indication is generated. Preferably, the value at which the test opening is initialized is determined based on the results of a prior execution of the flow restriction test so as to minimize the duration of the test and its impact on engine operation.

With the test method of the present invention, the test opening of the EGR valve is adaptively determined based on the measured intake manifold pressure change, and is never larger than required to reliably detect a debilitating EGR restriction. Thus, the test opening remains relatively small if the EGR system is substantially unrestricted, but is capable of achieving a very large value if the EGR system is significantly restricted. This, in turn, allows reliable detection of a borderline failing EGR system with less test result variability, while preventing degradation of combustion stability and emissions in a substantially unrestricted EGR system.

DETAILED DESCRIPTION OF THE DRAWINGS

Figure 1:
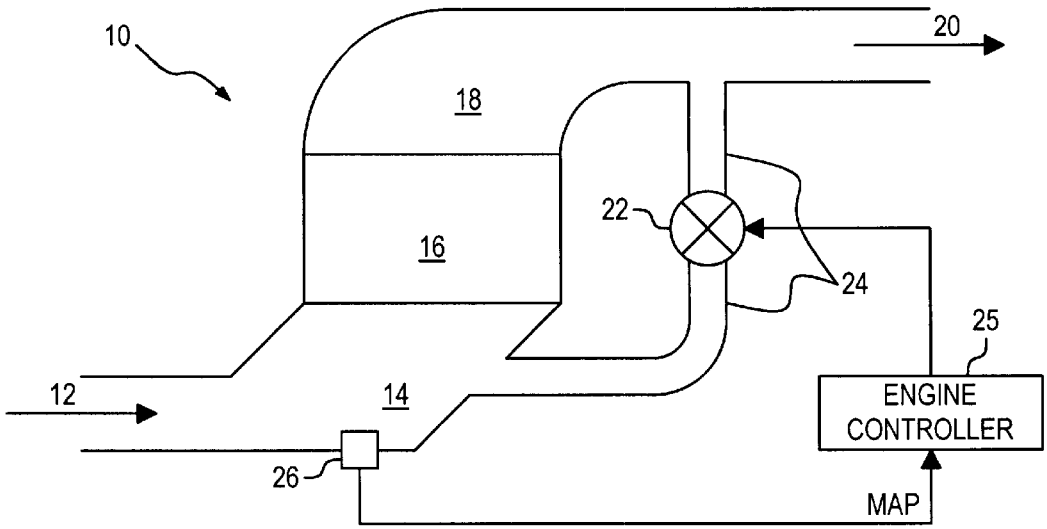
FIG. 1 is a schematic diagram of a vehicle EGR system, including a microprocessor-based engine controller.

Referring to FIG. 1, the reference numeral 10 generally designates a motor vehicle power plant, wherein an intake air stream 12 enters an intake manifold 14 and is combusted with a suitable quantity of fuel in engine 16, and wherein the combustion exhaust gases 20 exit through an exhaust manifold 18. An EGR system including EGR valve 22 and associated connective tubing 24 connects the exhaust manifold 18 to the intake manifold 14, allowing exhaust gases in exhaust manifold 18 to flow into the intake manifold 14. The EGR valve 22 may be fully closed so that there will be no exhaust gas flow through tubing 24, or it may be either partially or fully open so that there will be some amount of exhaust gas recirculated into and mixed with the intake air stream 12. A microprocessor-based controller 25 regulates the opening of EGR valve 22 in accordance with a predefined schedule for reducing exhaust gas emissions, as explained above. A pressure sensor 26 senses the absolute pressure in intake manifold 14, and provides a corresponding signal (MAP) to controller 25 to aid in diagnosing the proper operation of the EGR valve 22 and associated connective tubing 24.

A diagnostic EGR flow test is performed under conditions during which the EGR valve 22 is normally closed, such as during vehicle deceleration. The purpose of the EGR flow test is to detect the presence of a restriction in the EGR valve 22 and/or associated connective tubing 24 that impedes the scheduled flow of exhaust gas to the intake manifold 14. Since EGR flow increases the pressure in intake manifold 14, a given change in EGR flow produces a corresponding change in the MAP signal generated by pressure sensor 26. The flow test is initiated with EGR valve 22 in the normal fully closed position, and a corresponding initial MAP signal value is recorded. The controller 25 then commands the EGR valve 22 to test opening, records a corresponding final MAP signal value, and computes the pressure change according to the difference between the initial and final MAP signal values. The pressure change is then compared to a threshold based on the minimum expected change in intake manifold pressure for an EGR system that is regarded as functioning within acceptable limits. If the measured pressure change is greater than or equal to the threshold, the EGR system passes the diagnostic test. If the measured pressure change is less than the threshold, the EGR system fails the diagnostic test.

Figure 2:
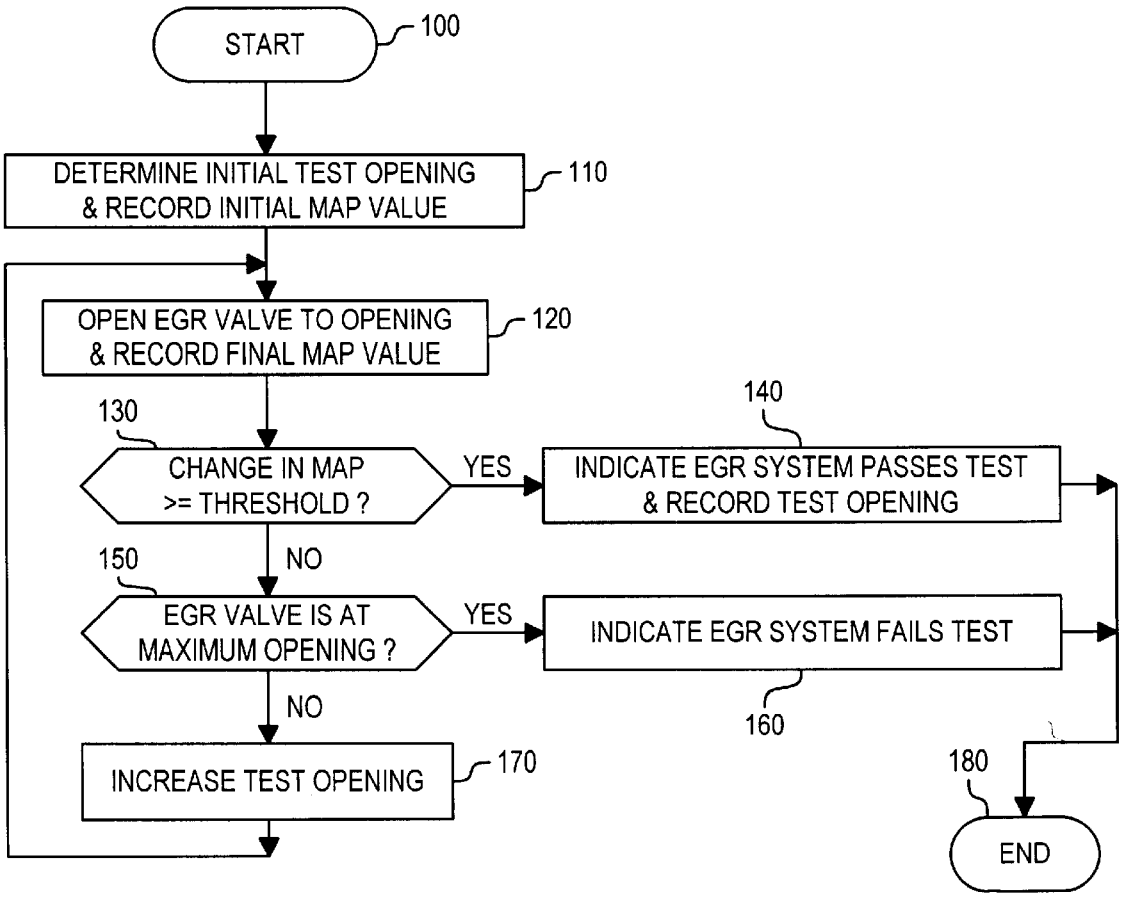
FIG. 2 is a flowchart representative of instructions executed by the controller of FIG. I in carrying out the test method of the present invention.

The present invention is directed to an improved EGR flow restriction test method substantially as described above, but wherein the test opening of the EGR valve 22 is adaptively determined to minimize the test opening while affording reliable detection of a debilitating EGR system restriction. FIG. 2 is a flow diagram representative of program instructions executed by the controller 25 in carrying out the improved flow test method. The test is initiated at block 100 by recording the initial MAP signal value when the enabling conditions are met and the EGR valve 22 is fully closed. At block 110, the controller 25 determines an initial test opening for EGR valve 22. The initial test opening may be a predetermined fraction of the maximum valve opening that minimizes degradation of engine operation for an EGR system with substantially unrestricted flow, but in subsequent testing may be determined based on a test opening recorded during earlier flow restriction testing, as explained below. At block 120, the controller 25 commands the EGR valve 22 to the test opening and records the final MAP signal value. At block 130, the controller 25 compares the pressure change (that is, the difference between the recorded initial and final MAP signal values) to a threshold based upon the minimum expected pressure change for an EGR system that is regarded as functioning within acceptable limits. If the measured pressure change is greater than or equal to the threshold, the block 140 is executed to record the current test opening, and to indicate that the EGR system passed, whereupon the flow test is terminated as indicated at block 180. As indicated above, the test opening recorded at block 140 is used to initialize the test opening during the next execution of the flow restriction test; for example, the test opening may be initialized to a predetermined fraction of the recorded test opening. Initializing the test opening in this manner allows controller 25 to learn from prior testing for the purpose of minimizing the duration of test and its impact on engine operation.

If the measured pressure change is less than the threshold, either the EGR valve 22 has not been opened enough to produce the expected pressure change, or the EGR system is flow restricted. Thus, if block 130 is answered in the negative, block 150 determines if the EGR valve opening has reaches a maximum possible opening. If not, then it is possible that the test could be passed by increasing the test opening; in this event, the block 170 is executed to increase the test opening, whereupon the foregoing blocks are re-executed to position the EGR valve 22 accordingly and re-compute the pressure change. However, if the re-computed pressure change never exceeds the threshold, and block 150 determines that the EGR valve 22 has reached the maximum possible opening, the EGR system is deemed to be restricted and the block 160 is executed to indicate that the EGR system failed the flow test, whereupon the flow test is terminated as indicated at block 180.

In summary, the adaptive selection of an EGR test opening in accordance with the present invention improves the detection reliability of a restricted EGR system while minimizing any degradation of combustion stability and exhaust emissions in a substantially un-restricted EGR system. Compared to a conventional test procedure based on a fixed EGR valve test opening, the exhaust emissions and driveability are improved because the EGR valve 22 is only opened to the extent required to produce a given intake manifold pressure change, and the indicated useful life of the EGR system is extended because the test opening can be increased to the maximum possible amount in an acceptably restricted EGR system.

While described in reference to the illustrated embodiment, the present invention is not limited thereto, and it is expected that various modifications in addition to those mentioned above will occur to those skilled in the art. Thus, it will be understood that methods incorporating these and other modifications may fall within the scope of this invention, which is defined by the appended claims.

What is claimed is:

1. A method for flow restriction testing an engine EGR system including an EGR valve and associated tubing for directing a flow of engine exhaust gas into an engine intake manifold, the method including the steps of increasing an opening of the EGR valve to a test opening, measuring a pressure change in the intake manifold from an initial pressure due to the increased opening of the EGR valve, and indicating a passing EGR system if the measured pressure change exceeds a threshold based on a minimum expected change in intake manifold pressure for an EGR system functioning within acceptable limits, the improvement wherein:

the test opening is initialized at a determined value that minimizes degradation of engine operation for an EGR system with substantially unrestricted flow of engine exhaust gas;

if the measured pressure change due to the test opening is less than said threshold, periodically increasing the test opening and re-measuring the pressure change due to the increased test opening;

if the re-measured pressure change exceeds the threshold, indicating a passing EGR system and recording the test opening in effect when the re-measured pressure change exceeds the threshold;

if the test opening is increased to a maximum opening without the re-measured pressure change exceeding the threshold, indicating a failing EGR system; and at a subsequent time during operation of the engine, repeating said flow restriction testing with said test opening initialized to a new value based on said recorded test opening.

2. The method of claim 1, wherein the initial pressure is a measured pressure in the intake manifold corresponding to a closed position of said EGR valve.

3. The method of claim 1, wherein said new value is a predetermined fraction of said recorded test opening.

4. The method of claim 1, including the steps of:

increasing the test opening if the measured or re-measured pressure change is less than said threshold and the test opening is less than said maximum opening; and indicating a failing EGR system if the test opening is increased to said maximum opening and the re-measured pressure change corresponding to said maximum opening is less than said threshold.

* * * * *